United States Patent [19]

Berg

[11] Patent Number: 4,671,004

[45] Date of Patent: Jun. 9, 1987

[54] VEHICLE MOUNTED PORTABLE SIGN

[76] Inventor: Marlin C. Berg, 5851 Farmington Rd., West Bloomfield, Mich. 48033

[21] Appl. No.: 874,877

[22] Filed: Jun. 16, 1986

Related U.S. Application Data

[63] Continuation of Ser. No. 723,917, Apr. 6, 1985, abandoned.

[51] Int. Cl.[4] ..... G09F 21/04

[52] U.S. Cl. ..... 40/592; 40/564

[58] Field of Search ..... 40/592, 564

[56] References Cited

U.S. PATENT DOCUMENTS

| | | | |
|---|---|---|---|
| 2,077,585 | 4/1937 | Rivers | 40/592 |
| 2,836,914 | 6/1958 | Nelson et al. | 40/592 |
| 3,208,173 | 9/1965 | Shank | 40/592 |
| 3,305,961 | 2/1967 | Lanzon et al. | 40/592 |
| 3,440,748 | 4/1969 | Hackley | 40/592 |
| 3,828,456 | 8/1974 | Rose | 40/592 |
| 4,523,400 | 6/1985 | Seely | 40/156 |

*Primary Examiner*—Gene Mancene
*Assistant Examiner*—Wenceslao J. Contreras
*Attorney, Agent, or Firm*—Krass & Young

[57] ABSTRACT

A portable sign mountable upon the roof of a vehicle. The portable sign is in the form of a hollow body having three side walls, a top wall and a bottom wall interconnected in a triangular form. The forwardmost edge of the interconnected side walls is positionable towards the front end of the vehicle for reduced wind resistance. Suction cups are mounted on the bottom wall of the body and in conjunction with strap members also mounted on the bottom wall of the body and connectable to the vehicle to provide for secure and removable attachment of the sign body on the roof of the vehicle. Detachable cover members carrying printed indicia are attachable on the side walls of the body to change the printed indicia on the sign. An illumination source is mounted within the body for illuminating the printed indicia formed on the side walls of the body.

7 Claims, 4 Drawing Figures

VEHICLE MOUNTED PORTABLE SIGN

This application is a continuation of application Ser. No. 723,917, filed Apr. 6, 1985, now abandoned.

BACKGROUND OF THE INVENTION

1. Field of the Invention

This invention relates, in general, to signs and, more specifically, to portable signs mounted on vehicles.

2. Description of the Prior Art

Signs have been long mounted on the sides or roofs of vehicles for various advertising or identification purposes. The roof mounted sign has met with particular popularity due to its ease of visibility from all sides of the vehicle so as to advertise the purpose of the vehicle or identifying what product is currently being transported by the vehicle.

Such signs have been fabricated from various materials, such as metal, plastic, paper, etc. Typically, these vehicle mounted signs are formed of a body which is removably mounted on the roof of the vehicle to which various advertising or other printed matter is attached or imprinted.

The sign body itself is removably mounted on the roof via straps, guy lines, suction cups or a combination thereof so as to enable the sign to be removably mounted on the vehicle.

Typically, due to the printed matter employed with such signs, they are not visible at night or in other periods of limited visibility.

It is also known to employ illuminated signs on vehicles, such as taxis, etc., to indicate the name of the taxi company or whether the taxi is in use. However, such signs or indiciators have not been removably mounted on the vehicle; but are made a permanent part of the vehicle.

Such illuminated signs, however, have not proved entirely useful during daylight hours as the illumination provided interiorally within the sign is not sufficient to clearly make the printed matter on the sign more visible or to attract attention to the sign.

It is also important that such vehicle mounted signs be constructed to minimize wind resistance against forward movement of the vehicle and at the same time provide the maximum amount possible of visible sign space.

Thus, it would be desirable to provide a vehicle mounted portable sign which overcomes the problems encountered with previously devised vehicle mounted portable signs. It would also be desirable to provide a vehicle mounted portable sign which is readily visible during the day, night time and other periods of limited visibility. It would also be desirable to provide a vehicle mounted portable sign which may receive a variety of different printed matter. It would also be desirable to provide a vehicle mounted portable sign which can be removably attached in an easy manner on the roof of a vehicle. Finally, it would be desirable to provide a vehicle roof mounted portable sign which minimizes wind resistance caused by the sign to the forward movement of the vehicle.

SUMMARY OF THE INVENTION

The present invention is a portable sign which is removably mountable on the roof of the vehicle, such as an automobile.

The sign includes a body having three upstanding side walls formed into a triangle. Upper and lower frame members attach top and bottom walls to the upper and lower edges of the side walls of the body. One pointed apex of the triangular formed body is positioned toward the front of the vehicle for minimal wind resistance toward forward movement of the vehicle caused by the sign.

A plurality of suction cups are mounted on the bottom surface of the body for removably attaching the sign on the roof of the vehicle. In addition, for additional securement of the sign on the vehicle roof, a plurality of straps attached at one end to opposite sides of the body may be connected in a secure manner to the side drip moldings of the vehicle to securely and yet removably mount the sign on the roof of the vehicle.

An illumination means in the form of a florescent bulb or a plurality of incadescent bulbs is mounted within the body and connected via a suitable connector to the electrical system of the vehicle to provide electrical power from the vehicle battery to the illumination means.

Spaced clips may also be attached to one or more of the side walls of the body for slidingly receiving additional, opaque sheets containing printed indicia so as to convert the sign of the present invention for effective and advantageous use during daylight hours when internal illumination is not required or does not provide sufficient illumination to make the indicia on the side wall of the sign body readily visible.

The vehicle mounted portable sign of the present invention overcomes many of the problems encountered with previously devised vehicle mounted signs by enabling the signs to be readily visible during both daylight, and other periods of limited visibility night time hours by means of the internal illumination means mounted within the sign body and the provision of the spaced guide tracks for receiving additional, opaque printed matter for use during daylight hours when illumination is not required or would not be effective.

The sign of the present invention may be readily and easily mounted on the roof of any vehicle. Furthermore, due to the unique design of the sign body, the sign of the present invention provides minimal wind resistance to forward movement of the vehicle which has been caused by previously devised vehicle mounted signs.

Finally, the complete use of plastic for the sign body and frame provides a lightweight, weatherproof sign which can receive indicia via most printing processes, such as silk screening.

BRIEF DESCRIPTION OF THE DRAWING

The various features, advantages and other uses of the present invention will become more apparent by referring to the following detailed description and drawing in which.

DESCRPTION OF THE PREFERRED EMBODIMENTS

Figure 1:
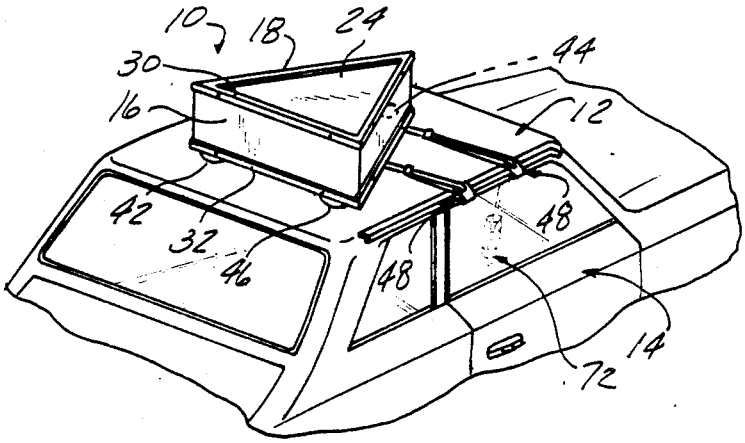
FIG. 1 is a perspective view of a vehicle having a portable sign constructed in accordance with the teachings of the present invention mounted thereon.

Throughout the following description and drawing an identical reference number is used to refer to the same component shown in multiple figures of the drawing.

Figure 2:
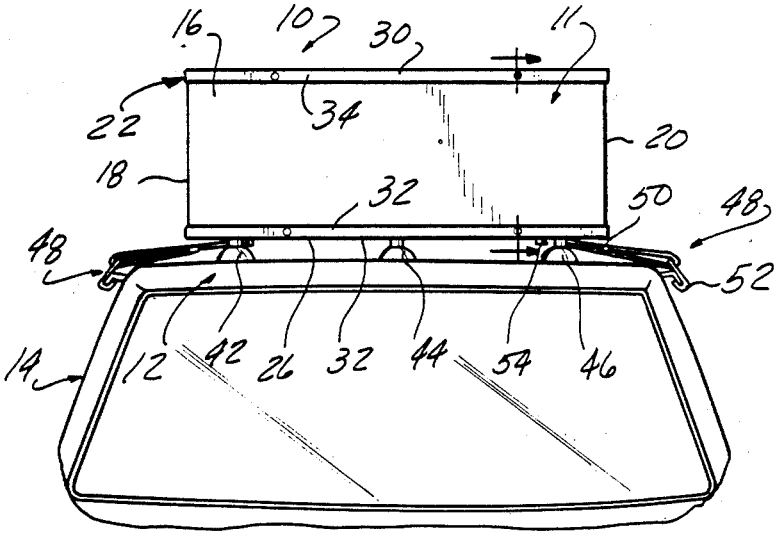
FIG. 2 is a rear view of the sign and vehicle shown in FIG. 1.

Refering now to FIGS. 1 and 2, there is illustrated a portable sign 10 which is removably mounted upon the roof 12 of a vehicle 14, such as an automobile. The sign 10 is configured for carrying various printed indicia directly thereon or in a removably attachable manner as described hereafter.

The sign 10 is in the form of a hollow body 11 comprised of first, second and third side walls 16, 18 and 20, respectively, which are integrally formed from a single piece strip of a suitable plastic material formed in a triangular form. The plastic material may be any transparent, semi-transparent or opaque plastic material which carries various printed indicia, not shown, for advertising or display purposes. The indicia can be applied to the side walls 16, 18 and 20 in any suitable manner such as by silk screening.

The side walls 16, 18 and 20 include two integral edges and one overlapped, vertically-extending edge.

An external frame denoted in general by reference number 22 includes under and lower triangular frame members 30 and 32, respectively. The frame 22 attaches top and bottom walls 24 and 26, resepectively, to the upper and lower edges of the side walls 16, 18 and 20 to form a closed, hollow interior within the sign body 12.

The frame 22 is preferably formed of a plastic material to provide a lightweight, weatherproof assembly.

Figure 3:
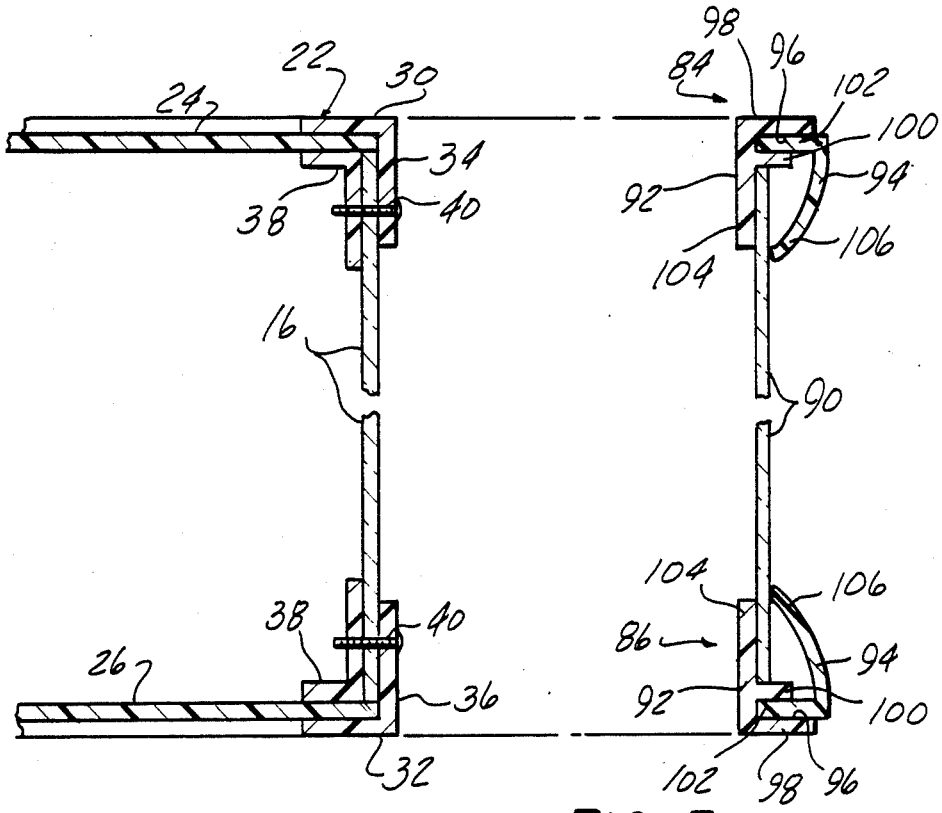
FIG. 3 is a cross sectional view generally taken along line 3—3 in FIG. 2.

The frame 22 includes upper and lower frame members 30 and 32, respectively, which have a L-shaped cross section are formed into the triangular configuration of the sign 10. The outer legs 34 and 36, respectively, of each of the frame members 30 and 32 are disposed in proximity with one of the side walls 16, 18 and 20 of the sign body 11. L-shaped flange members 38, shown in FIG. 3, are mounted, such as by the use of adhesive, on the upper and lower surfaces 24 and 26 of the sign body 11 at spaced intervals in registry with the interior surfaces of the outermost edges of the side walls 16, 18 and 20. Fasteners 40 are mounted through apertures formed in the legs 34 and 36, the ends of the side walls 16, 18 and 20 and the flange members 38 for joining the frame 22, the side walls 16, 18 and 20 and the top and bottom walls 24 and 26 of the sign body 11 into an integral, solid, closed structure.

Means are also provided for securely and detachably mounting the sign body 11 on the roof 12 of the vehicle 14. Such mounting means comprises a plurality of suction cups, such as suction cups 42, 44 and 46. The suction cups 42, 44 and 46 are conventional in construction and are secured by means of fasteners to the bottom surface 26 of the side body 11. The suctions cups 42, 44 and 46 enable the body 11 to be mounted on the roof 12 of the vehicle 14 by appropriately positioning the sign body 10 in the desired location on the roof 12 and applying downward pressure thereby creating a suction within the suction cups 42, 44 and 46 to detachably but yet securely mount the body 11 on the roof 12 of the vehicle 14.

The securing and detachably mounting means also includes strap members, such as strap members 48, which are preferably provided in opposed parts attached to the bottom wall surface 26 of the sign body 11, preferably in proximity with the opposed side walls 18 and 20. Each of the strap members 48 comprises an elongated strap 50 and a substantially L-shaped clamp or hook member 52. Each of the hook members 52 has an aperture located therein which receives one end of the associated strap member 50. The opposite end of each strap member 50 is secured to the bottom surface 26 of the sign body 10 by a suitable fastener 54 as shown in FIG. 2.

The opposite end of each strap member 50 is provided with a clasp which enables a loop to be formed on each strap member 50 after it has been inserted through the aperture in the clamp member 52 and secured in a tightened manner to securely mount the body 11 on the roof 12 on the vehicle 14 in conjunction with the suction cups 42, 44 and 46.

Figure 4:
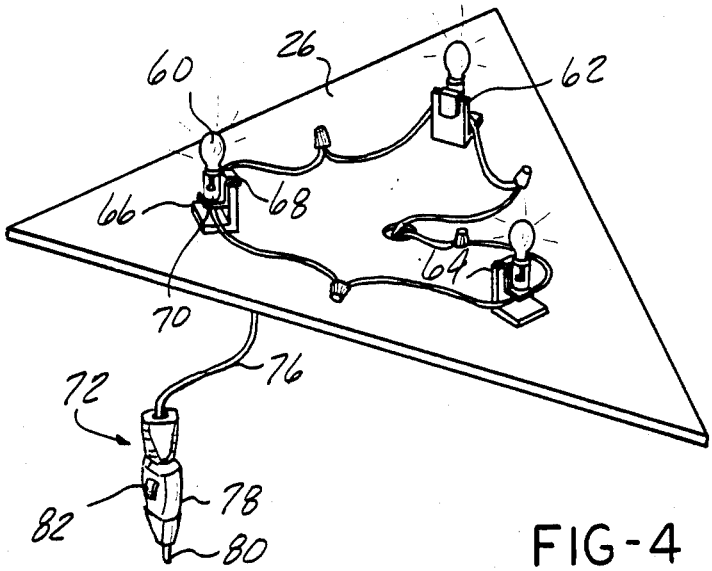
FIG. 4 is a perspective view showing the bottom of the sign body of the present invention and illustrating the illumination means of the sign of the present invention.

The sign body 11 also includes illumination means for illuminating the interior of the body 11 and thereby illuminate the printed indicia on the side wall 16, 18 and 20. As shown in FIG. 4, the illumination means comprise at least one and preferably a plurality of lights 60. In the preferred embodiment of the present invention, three incandescent lights, 60, 62 and 64 are utilized to provide illumination of the sign 10. It will also be understood that other forms of illumination means, such as single or multiple floresent bulbs, may also be mounted within the sign body 11 to adequately illuminate the printed indicia disposed on the side walls 16, 18 and 20 of the sign body 11.

As shown specifically in FIG. 4, each light bulb, such as light bulb 60, is attched to an L-shaped strap 66 secured to the bottom wall surface 26 of the sign body 10. A clip 68 is mounted around one upstanding leg of the strap 66 to which a light bulb receptacle 70 is attached. Wires extending outward from the receptacle 70 are interconnected in a conventional series circuit with an electrical connection means denoted in general by reference number 72 in FIGS. 1 and 4. The electrical connection means comprises an elongated cord 76 which terminates in a plug assembly 78 having an outwardly extending projection 80 as well as a grounding contact 82 mounted on the body of the plug assembly 78. The plug assembly 78 preferably is configured to be removably received within the conventional cigarette lighter mounted within the vehicle 14 to thereby connect the illumination means of the present invention to the battery of the vehicle 14 in order to provide electrical power to the lights 10.

It is also possible to form the connector 72 so as to be removably connectable directly to the battery of the vehicle or to another convenient electrical connection point such as the vehicle tailights. In such configurations, a toggle switch may be mounted on the bottom surface of the bottom wall surface 26 and connected in series with the electrical circuit to the battery of the vehicle to enable selective energization of the illumination means.

Since illuminating the sign 10 may not be desired or completely effective during daylight hours, it is also possible within the scope of the present invention to mount an overlay or cover assembly 83 containing additional printed matter or indicia on on a planar sheet 90 one or more of the side walls 16, 18 and 20 to provide a more effective display of such printed indicia or to change the printed indicia which is permanently formed on the side walls 16, 18 and 20 of the sign body 11. It is preferred that the planar member 90 be of an opaque material so as to completely cover the printed material on the side walls 16, 18 and 20.

As shown in FIG. 3, the cover assembly 83 includes two clips 84 and 86, each formed of a backing member 92 and a cover member 94. The backing memeber 92 includes a slot 96 formed between two spaced flanges 98 and 100. The slot 100 removably receives a flange 102 formed on the lower member 94 in a snap-tight fit. The depending legs 104 and 106 of the backing member 92 and the cover 94, respectively, grasp the edges of the planar sheet 90 and securely retain the sheet 90 in the clips 92 and 94.

The overlay or cover 83 may be attached or mounted on the frame 22 by any suitable removable means, such as an all temperature adhesive, Velcro-type fastners or other securement members suitable to withstand the temperatures, vibrations and other operating conditions encountered during use of a vehicle.

The overlay 83 enables the sign 10 of the present invention to be used during daylight hours when illumination is not required or would not be effective to illuminate the sign and attract attention thereto. Furthermore, the indicia contained upon the sign body 10 may also be changed as desired at various times the use of the sign 10 during daylight hours by merely placing different overlays 83 each containing other printed matter on the frame 22 of the sign 10.

In summary, there has been disclosed an unique vehicle mounted portable sign which overcomes many of the problems encountered with previously devised vehicle mounted portable signs insofar as providing clear visibility of printed matter on the sign, versatility in the emplacement of various printed indicia on the sign, minimal wind resistance to forward movement of the vehicle caused by the mounting of the sign on the roof of the vehicle, as well as ease in removably mounting the sign on the vehicle.

What is claimed is:

1. A portable sign for a vehicle having a roof and an electrical system powered by an electrical battery source, the portable sign comprising:

a body having first, second and third side walls at least two of which are formed of a continuous strip, at least certain of which have indicia formed thereon, a top wall and a bottom wall, the first, second and third side walls being formed into a triangle having vertically extending edges;

upper and lower, spaced frame members, each having a substantially planar triangular form, the upper and lower frame members interconnecting only the top and bottom edges of the top and bottom walls, respectively, to the adjacent top and bottom edges of the first, second and third side walls to leave the vertically extending edges of the first, second, and third side walls exposed;

a plurality of suction cups mounted on the body for removably mounting the body on the vehicle roof;

strap means, secured to the body at one end and removably engageable with the vehicle at the other end for removably mounting the body on the vehicle in conjunction with the suction cups; and illuminating means, mounted within the body and removably connectable to the battery of the vehicle, for illuminating the indicia on the side walls of the body.

2. The portable sign of claim 1 wherein the first, second and third side walls, the top wall, the bottom wall and the upper and lower frame members of are completely formed of plastic material.

3. The portable sign of claim 1 further including cover members removably mountable over the side walls of the body; and the cover members being formed of an opaque material and having printed indicia disposed thereon.

4. The portable sign of claim 3 further including:

first and second clips, each removably receiving one edge of a cover member and being removably attachable to the side walls of the body for mounting the cover members on the side walls of the body; and means for removably mounting the first and second channel members on the side wall of the body.

5. The portable sign of claim 1 wherein printed indicia is formed on the side walls of the body.

6. A portable sign for a vehicle having a roof, said sign comprising:

(A) a body having first, second and third sidewalls, at least two of which are formed of a continuous strip, the first, second and third sidewalls being formed into a rigid triangular body structure having vertically extending apexes;

(B) a top structure including a triangular planar top wall section and a frame section including a downturned flange extending in triangular fashion totally around the laterally outer triangular perimeter of said top wall section, said downturned flange having an internal circumferential size and shape generally corresponding to the external circumferentail size and shape of said triangular body structure;

(C) a bottom structure including a triangular planar bottom wall section and a frame section including an upturned flange extending in triangular fashion totally around the laterally outer triangular perimeter of said bottom wall section, said upturned flange having an internal circumferential size and shape generally corresponding to the external circumferential size and shape of said triangular body structure;

(D) the upper edge portion of said triangular body structure being positioned within said downturned flange of said top structure and attached to said top structure and the lower edge portion of said triangular body structure being positioned within said upturned flange of said bottom structure and attached to said bottom structure so that said rigid body structure forms the sole interconnection between said top structure and said bottom structure to thereby form a substantially triangular tubular body structure with the vertically extending apexes of said triangular body structure totally exposed and with said sidewalls coacting to form a continuous closed loop viewing display surface extending 360° with respect to the central vertical axis of the sign;

(E) a plurality of spacer members attached to the underside of said bottom structure for seating on the roof of the vehicle; and (F) strap means secured at one end thereof to said sign and removably engageable with the vehicle at the other end thereof for removably mounting said sign on the roof of the vehicle in cooperation with said spacer members.

7. A portable sign according to claim 6 wherein:

(G) said upper edge portion of said triangular body structure is attached to said top structure by fastener members extending through said downturned flange for engagement with said upper edge portion of said triangular body structure and said lower edge portion of said triangular body structure is attached to said bottom structure by further fastener members extending through said upturned flange for engagement with said lower edge portion of said triangular body structure.

* * * * *